US011193657B2

(12) United States Patent
Weston et al.

(10) Patent No.: US 11,193,657 B2
(45) Date of Patent: Dec. 7, 2021

(54) FRAME SYSTEM FOR SECURING A LIGHTING FIXTURE TO A SURFACE

(71) Applicant: Hubbell Incorporated, Shelton, CT (US)

(72) Inventors: Russell James Weston, Greer, SC (US); Jared Roulier, Fountain Inn, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/871,498

(22) Filed: May 11, 2020

(65) Prior Publication Data

US 2020/0355352 A1 Nov. 12, 2020

Related U.S. Application Data

(60) Provisional application No. 62/846,063, filed on May 10, 2019.

(51) Int. Cl.

| | |
|---|---|
| ***F21V 21/04*** | (2006.01) |
| ***F21V 11/08*** | (2006.01) |
| ***F21V 21/30*** | (2006.01) |
| ***F21S 8/02*** | (2006.01) |
| ***F21V 7/06*** | (2006.01) |
| ***F21V 29/80*** | (2015.01) |

(52) U.S. Cl.

CPC ..... *F21V 21/04* (2013.01); *F21S 8/026* (2013.01); *F21V 11/08* (2013.01); *F21V 21/30* (2013.01); *F21V 7/06* (2013.01); *F21V 29/80* (2015.01)

(58) Field of Classification Search

CPC ..... F21V 21/041; F21V 21/047; F21V 11/08; F21S 8/028

See application file for complete search history.

(56) References Cited

U.S. PATENT DOCUMENTS

| | | | | |
|---|---|---|---|---|
| 6,578,808 | B1 * | 6/2003 | Bertagni | H04R 1/025 248/343 |
| 8,277,090 | B2 * | 10/2012 | Fryzek | F21V 21/14 362/366 |
| 10,760,751 | B1 * | 9/2020 | Bowen | F21V 17/164 |
| 10,859,243 | B2 * | 12/2020 | Simmons, Jr. | F21V 17/005 |
| 2008/0025031 | A1 | 1/2008 | Wronski et al. | |
| 2015/0377466 | A1 | 12/2015 | Gershowitz et al. | |
| 2017/0167672 | A1 * | 6/2017 | Stauner | F21V 3/00 |

FOREIGN PATENT DOCUMENTS

| | | |
|---|---|---|
| CA | 2244041 C | 5/2007 |

OTHER PUBLICATIONS

PCT/US2020/032330 International Search Report and Written Opinion dated Aug. 10, 2020 (17 pages).

* cited by examiner

*Primary Examiner* — Matthew J. Peerce

(74) *Attorney, Agent, or Firm* — Michael Best & Friedrich LLP

(57) ABSTRACT

A frame system for securing a lighting fixture to a surface is provided. The frame system can include a frame defining an opening. The frame can be configured to accommodate a selected insert of a plurality of inserts associated with the lighting fixture and coupleable to the frame. Each of the plurality of inserts can include an aperture defining portion of a different size or shape. The aperture defining portion of the selected insert can extend through the opening defined by the frame.

18 Claims, 19 Drawing Sheets

412 FIG. 6

FRAME SYSTEM FOR SECURING A LIGHTING FIXTURE TO A SURFACE

CROSS-REFERENCE TO RELATED APPLICATIONS

This application claims priority to U.S. Provisional Patent Application No. 62/846,063 filed May 10, 2019, the entire contents of which is incorporated by reference herein.

FIELD

The present disclosure relates generally to a frame system for lighting fixtures.

BACKGROUND

Recessed lighting fixtures can provide light for a space, such as a building or room, and are aesthetically pleasing since recessed fixtures are recessed within a ceiling. Recessed lighting fixtures can be configured in a plurality of different shapes or sizes. Furthermore, different mounting configurations can be used for mounting recessed lighting fixtures within the ceiling.

SUMMARY

Aspects and advantages of embodiments of the present disclosure will be set forth in part in the following description, or may be learned from the description, or may be learned through practice of the embodiments.

In one aspect, a frame system for securing a lighting fixture to a surface is provided. The frame system can include a frame defining an opening. The frame can be configured to accommodate a selected insert of a plurality of inserts associated with the lighting fixture and coupleable to the frame. Each of the plurality of inserts can include an aperture defining portion of a different size or shape. The aperture defining portion of the selected insert can extend through the opening defined by the frame.

In another aspect, a lighting fixture system is provided. The lighting fixture system can include a lighting fixture, a plurality of inserts associated with the lighting fixture and a frame system for securing the lighting fixture to a surface. Each of the plurality of inserts can have an aperture defining portion of a different size or shape. The frame system can include a frame coupleable to a selected insert of the plurality of inserts; and a platform coupleable to the frame via the selected insert. The platform can be further coupleable to the lighting fixture. When the frame is coupled to the selected insert, the aperture defining portion of the selected insert can extend through an opening defined by the frame.

In yet another aspect, a method for assembling a lighting fixture system is provided. The method can include selecting an insert from a plurality of inserts of the lighting fixture system. Each of the plurality of inserts can be associated with a lighting fixture of the lighting fixture system. Each of the plurality of inserts can include an aperture defining portion of a different size or shape. The method can also include securing the insert to a frame of lighting fixture system such that the aperture defining portion of the insert extends through an opening defined by the frame.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which:

FIG. 19 provides a side view of FIG. 18 according to example embodiments of the

DETAILED DESCRIPTION

Figure 1:
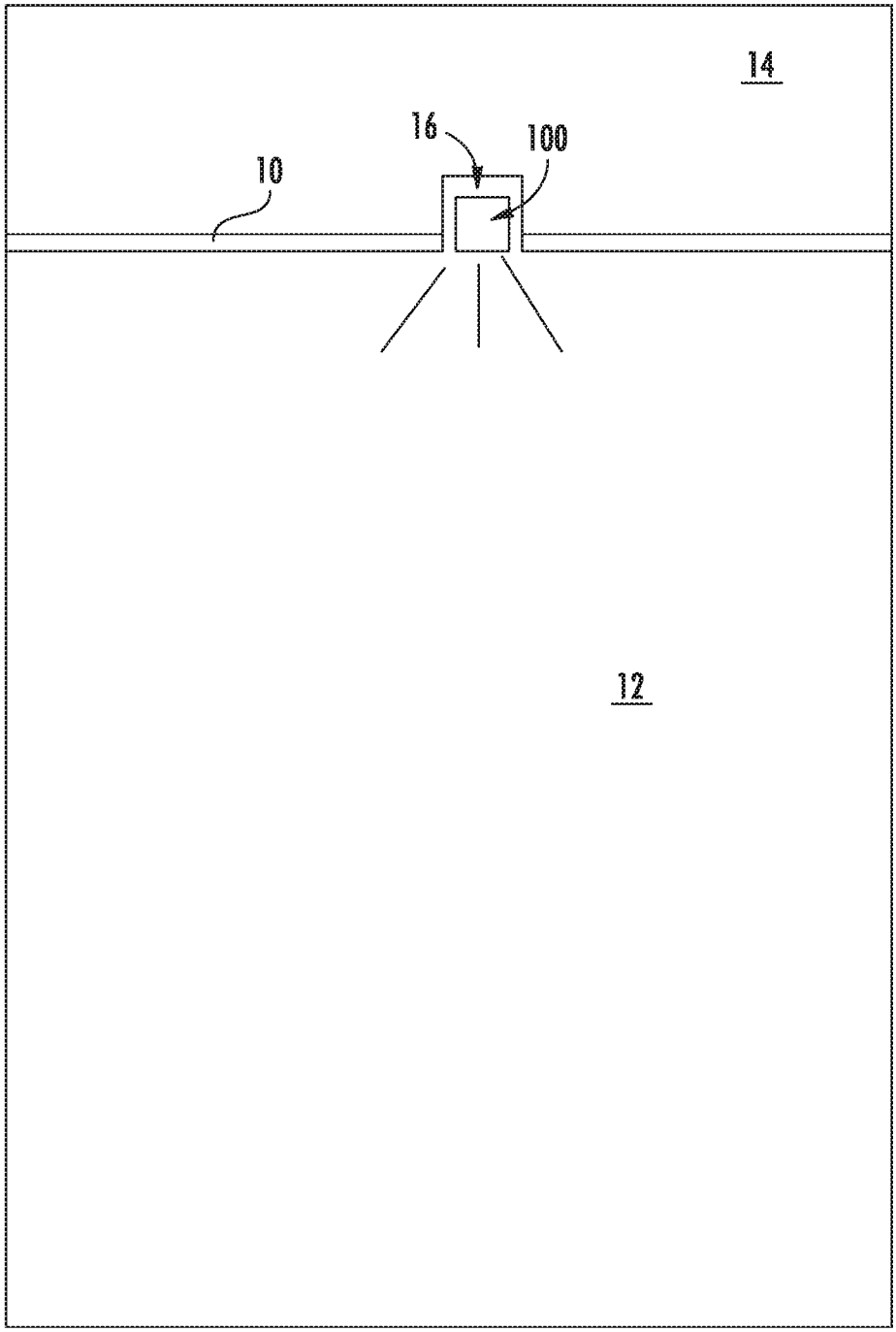
FIG. 1 provides a lighting fixture suspended within a ceiling according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a frame system for securing a lighting fixture to a surface (e.g., ceiling). The frame system can include a frame defining an opening configured to accommodate a selected insert of a plurality of inserts 505 associated with a lighting fixture and coupleable to the frame. Each of the plurality of inserts 505 can include an aperture defining portion of a different size or shape. Furthermore, in some implementations, the aperture defining portion of the selected insert can have a shape that is different than a shape of the lighting fixture.

In some implementations, the opening can be defined by a plurality of arc shaped edges of the frame. The plurality of arc shaped edges can collectively define an annular shape. In addition, the opening can be defined by a plurality of linear shaped edges of the frame. The plurality of linear edges can collectively define a rectangular shape. In this manner, the opening can be configured to accommodate the aperture-defining portion of the selected insert having an annular shape or a rectangular shape. More specifically, the opening can be configured to accommodate the aperture-defining portion of the selected insert such that the aperture-defining portion of the selected insert can extend through the opening defined by the frame.

In some implementations, a diameter of the annular shape collectively defined by the plurality of arc shaped edges can be less than a length of a diagonal extending between opposing corners or edges of the rectangular shape collectively defined by the plurality of linear shaped edges. In this manner, the opening defined by the frame can accommodate the aperture defining portion of the selected insert having an annular shape so long as a diameter of the aperture defining portion is less than the diameter of the annular shape collectively defined by the plurality of arc shaped edges of the frame. Furthermore, the opening defined by the frame can accommodate the aperture defining portion of the selected insert having a rectangular shape so long as a length of a diagonal extending between opposing corners of the rectangular shape is less than the length of the diagonal extending between opposing corners or edges of the rectangular shape defined by the plurality of linear shaped edges of the frame. Put another way, the opening defined by the frame can accommodate the aperture defining portion of the selected insert so long as the long dimension of the aperture defining portion is less than the long dimension of the opening.

In some implementations, the frame system can include a platform coupleable to the selected insert positioned on the frame. The platform can include a body defining an opening. In addition, the platform can include a plurality of mounting tabs extending from the body of the platform. In some implementations, the platform can be coupled to the selected insert such that the opening defined by the body of the platform is aligned with the opening defined by the frame. Furthermore, the lighting fixture can be mounted to the platform such that light emitted from a solid-state light source of the lighting fixture is emitted through the opening defined by the platform and the opening defined by the frame. In this manner, the light emitted from the solid-state light source can be emitted into a room or space positioned below the surface (e.g., ceiling) to which the lighting fixture is mounted.

The frame system of the present disclosure can provide technical benefits. For instance, the frame system can accommodate a plurality of different inserts associated with a lighting fixture, because the opening defined by the frame can accommodate inserts having aperture defining portions of different sizes or shapes. In this manner, the number of components of the frame system can be reduced, because the frame according to the present disclosure can accommodate inserts having aperture defining portions of different shapes or sizes.

As used herein, a "lighting fixture" refers to a device used to provide light or illumination using one or more light sources. In addition, the terms "first" and "second" may be used interchangeably to distinguish one component from another and are not intended to signify location or importance of the individual components.

FIG. 1 depicts a lighting fixture 100 according to example embodiments of the present disclosure. The lighting fixture 100 can be removably mounted to a ceiling 10 separating a first space 12 (e.g., positioned beneath the ceiling 10) from a second space 14 (e.g., positioned above the ceiling 10). For instance, the lighting fixture 100 can be disposed within an opening or recess 16 defined in the ceiling 10 when the lighting fixture 100 is mounted to the ceiling 10. As shown, the lighting fixture 100 can emit light to illuminate the first space 12.

Figure 2:
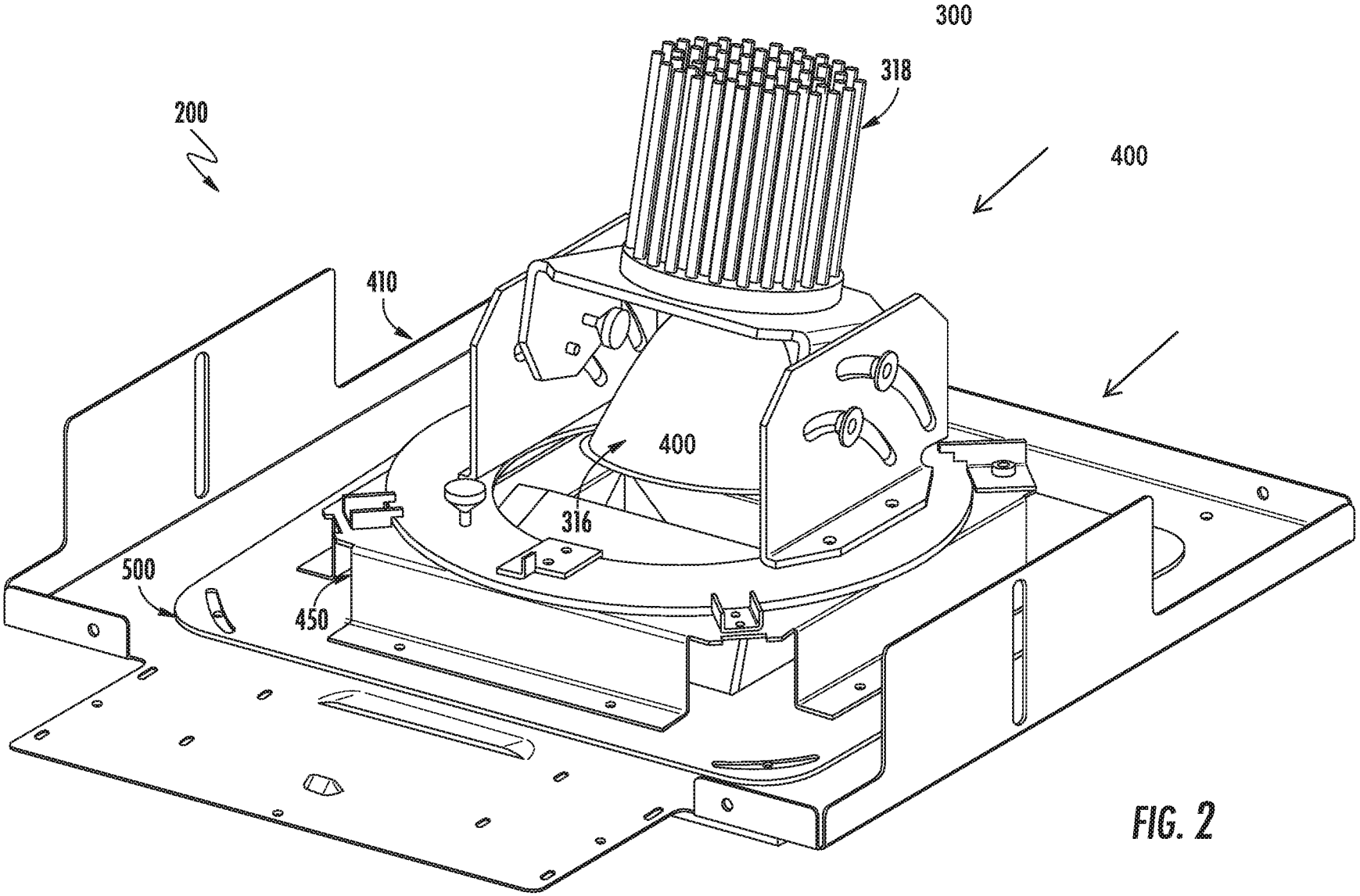
FIG. 2 provides a perspective view of a lighting fixture system according to example embodiments of the present disclosure.
Figure 3:
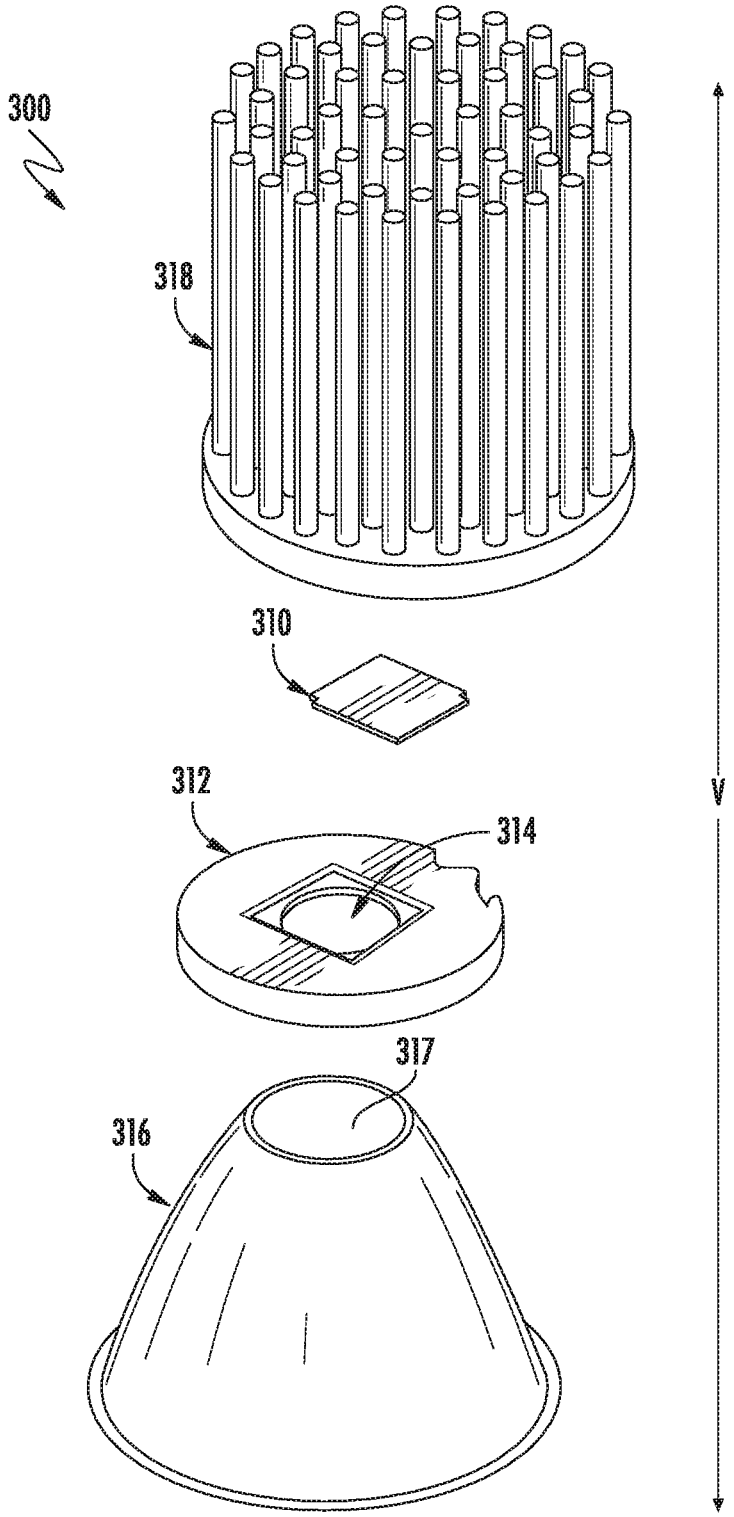
FIG. 3 provides an exploded view of a lighting fixture of a lighting fixture system according to example embodiments of the present disclosure.
Figure 7:
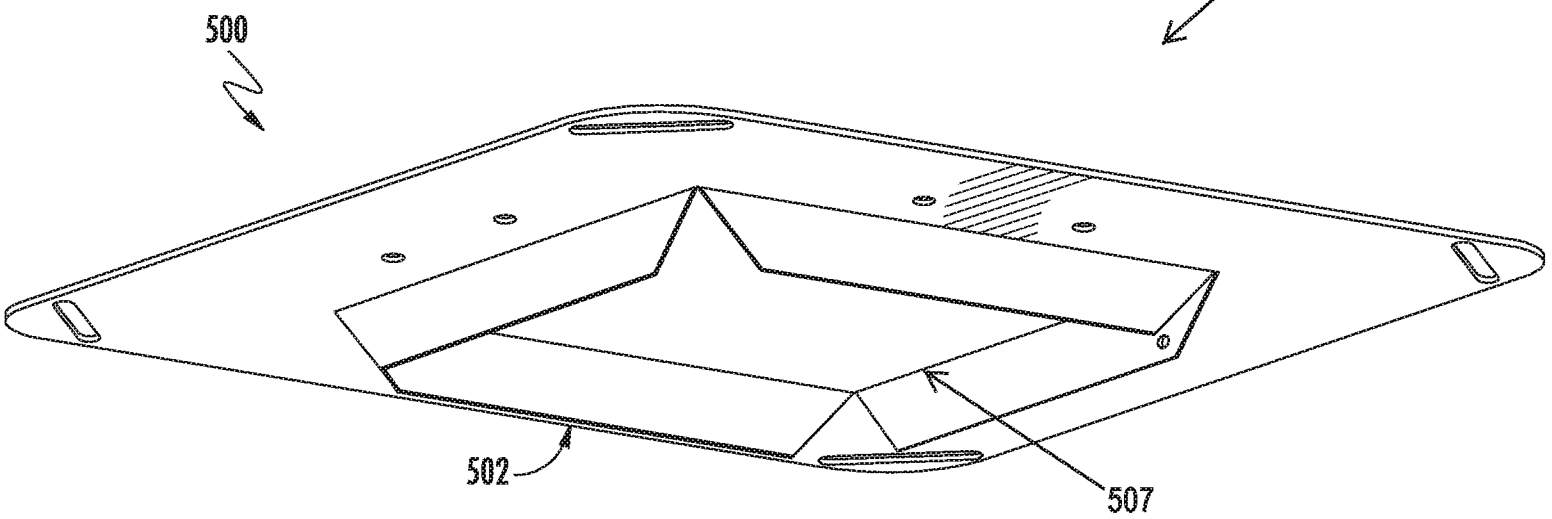
FIG. 7 provides a perspective view of an insert of a lighting fixture system according to example embodiments of the present disclosure.
Figure 8:
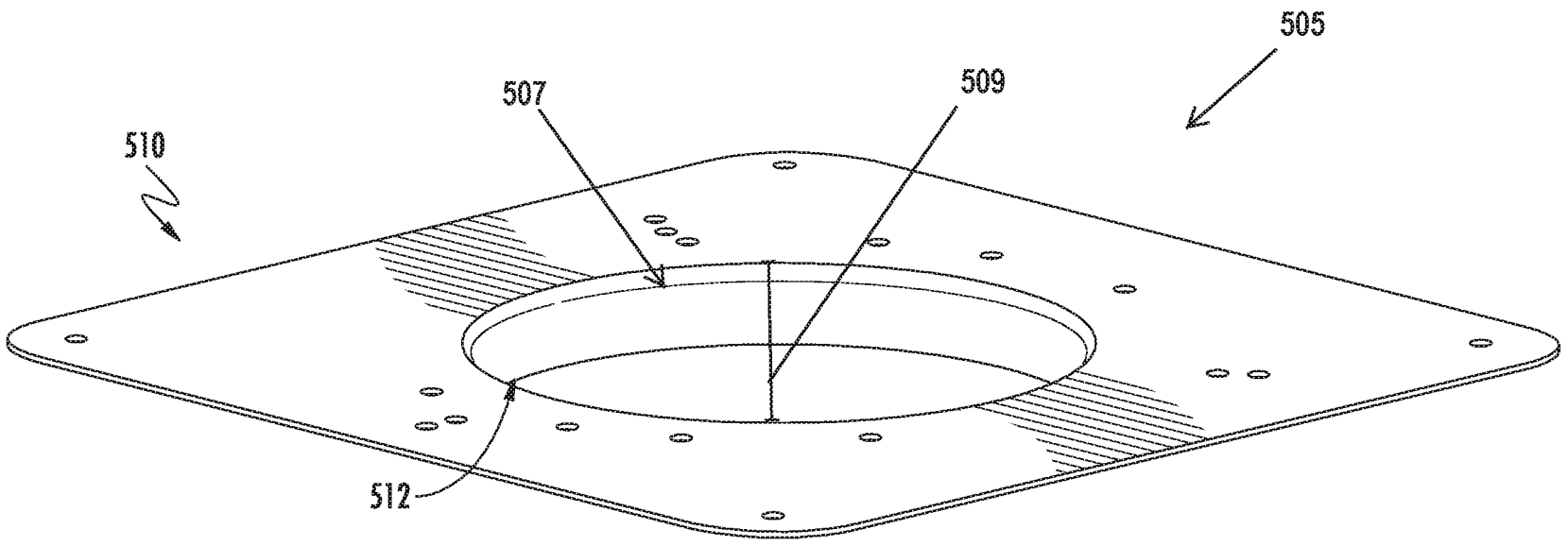
FIG. 8 provides another perspective view of an insert of a lighting fixture system according to example embodiments of the present disclosure.

Referring now to FIG. 2, a lighting fixture system 200 is provided according to the present disclosure. The lighting fixture system 200 can include a lighting fixture 300 (FIG. 3), a frame system 400 (FIG. 4), and a plurality of inserts 505 (FIGS. 7 and 8). As shown in FIG. 3, the lighting fixture 300 can include a solid-state light source 310. The solid-state light source 310 can include a light emitting surface (not shown) configured to emit light. It should be understood that the solid-state light source 310 can include any suitable type of solid-state light source. For instance, in some implementations the solid-state light source 310 can include a light emitting diode (LED) device having one or more LED light sources. Furthermore, in such implementations, it should be understood that the LED device can be powered by a LED driver circuit configured to convert an input power to a driver output suitable for driving the one or more LED light sources.

In some implementations, the lighting fixture 300 can include a support 312 defining an opening 314 configured to accommodate the solid-state light source 310. Alternatively and/or additionally, the lighting fixture 300 can include a reflector 316 coupleable to the support 312. In this manner, light emitted from the light emitting surface of the solid-state light source 310 can reflect off of an interior 317 of the reflector 316 at a non-parallel angle relative to a vertical direction associated with the lighting fixture system 200 (FIG. 2). In some implementations, the lighting fixture 300 can include a heat sink 318. In some implementations, the heat sink 318 can be coupled to the support 312. In this manner, the heat sink 318 can absorb heat associated with operation of the solid-state light source 310.

Figure 4:
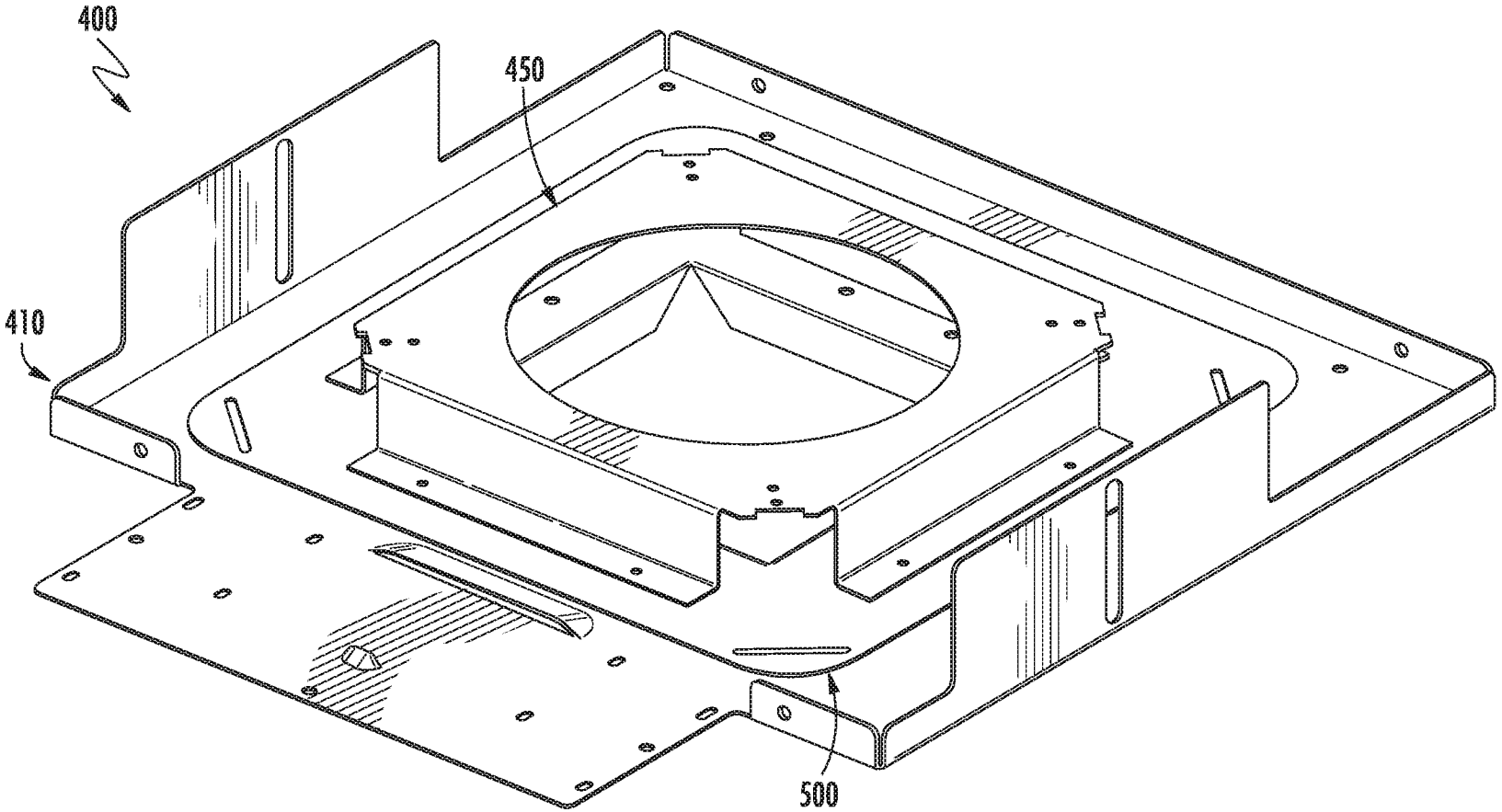
FIG. 4 provides a perspective view of a frame system of a lighting fixture system according to example embodiments of the present disclosure.
Figure 5:
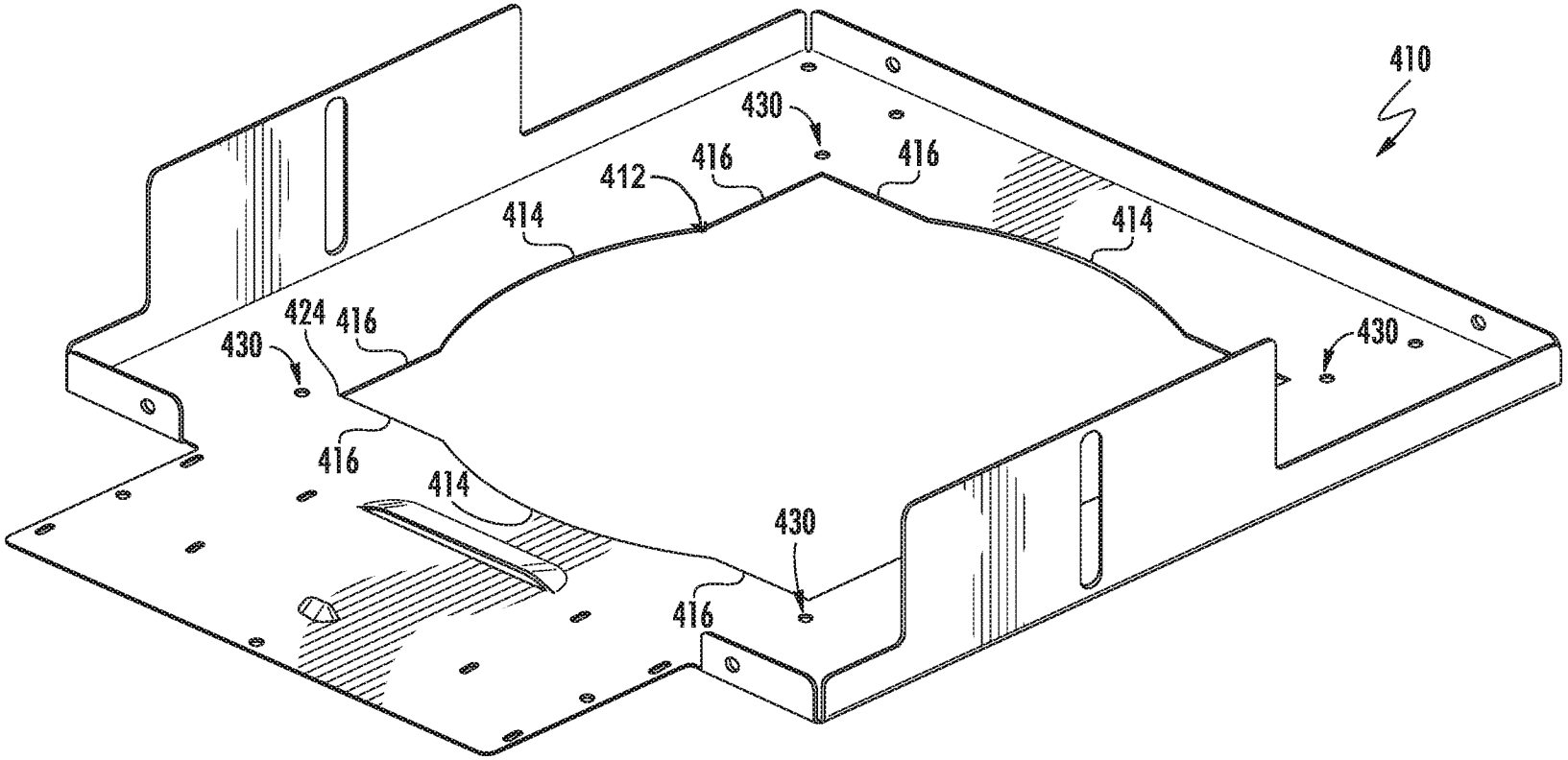
FIG. 5 provides a perspective view of a frame of a frame system according to example embodiments of the present disclosure.
Figure 6:
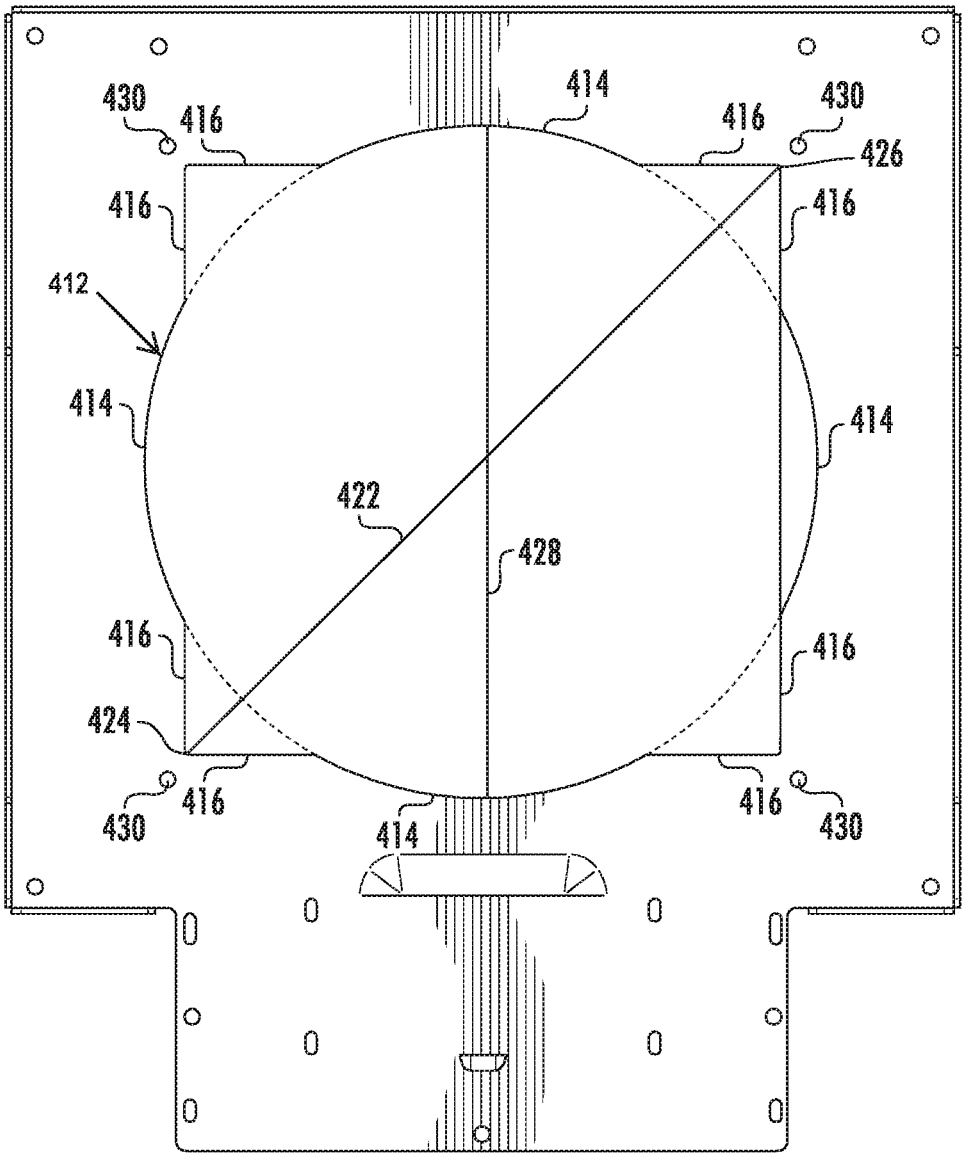
FIG. 6 provides a top view of the frame of FIG. 5 according to example embodiments of the present disclosure.

Referring now to FIG. 4, the lighting fixture system 200 (FIG. 2) can include a frame system 400 (FIG. 4) configured to secure the lighting fixture 300 (FIG. 3) to a surface, such as the ceiling 10 discussed above with reference to FIG. 1. As shown, the frame system 400 can include a frame 410. Referring briefly now to FIGS. 5 and 6, the frame 410 can define an opening 412. In the illustrated embodiment, the opening 412 is shaped as though a circular cutout was overlaid with a rectangular cut out such that the overall perimeter of the opening 412 includes alternating arc shaped edges 414 (representative of the circle) and linear edges 416 (i.e., corners representative of the rectangle). Connecting the arc shaped edges 414 to one another forms a circular shape while connecting the linear edges 416 to one another forms a rectangular shape.

Stated another way, the opening 412 can be defined by a plurality of arc shaped edges 414 and a plurality of linear edges 416 of the frame 410. As shown, the plurality of arc shaped edges 414 can collectively define an annular shape having a diameter 428. In addition, the opening 412 can be defined by the plurality of linear edges 416 of the frame 410. As shown, the plurality of linear edges 416 can collectively define a rectangular shape. In some implementations, a length of a diagonal 422 extending between opposing corners 424, 426 of the rectangular shape can be greater than the diameter 428 of the annular shape. As will be discussed below in more detail, the opening 412 defined by the frame 410 can be configured to accommodate a selected insert of a plurality of inserts 505 associated with the lighting fixture 300 (FIG. 3) and coupleable to the frame 410.

Referring now to FIGS. 7 and 8, the lighting fixture system 200 (FIG. 2) can further include a plurality of inserts (identified generally as 505) associated with the lighting fixture 300 (FIG. 3) and coupleable to frame 410 (FIG. 4). As shown, the plurality of inserts 505 can include a first insert 500 and a second insert 510. It should be understood that the plurality of inserts 505 can include more than two inserts. Each of the plurality of inserts 505 includes an aperture defining portion (identified generally as 507). As shown, the first insert 500 can include an aperture defining portion 502. Likewise, the second insert 510 can include an aperture defining portion 512.

It should be appreciated that each of the plurality of inserts 505 can include an aperture defining portion (identified generally as 507) having a different shape. For instance, the aperture defining portion 502 of the first insert 500 can define a rectangular shape. More specifically, the aperture defining portion 502 of the first insert 500 can define a square shape. Conversely, the aperture defining portion 512 of the second insert 510 can define an annular shape. More specifically, the aperture defining portion 512 of the second insert 510 can define a circular shape.

It should also be appreciated that the aperture defining portion 507 of each of the plurality of inserts 505 can have a different size. For instance, in some implementations, the aperture defining portion 507 of the first insert 500 and the second insert 510 can each define an annular shape. More specifically, the aperture defining portion 512 of the second insert 510 can define an annular shape of a first diameter 509. Conversely, the aperture defining portion 507 of the second insert 510 can define an annular shape of a second diameter that is different than the first diameter. For instance, the second diameter can be greater than the first diameter. Similarly, the first insert 500 and the second insert 510 can each define a rectangular shape having different sizes. For instance, the first insert 500 may have a rectangular aperture defining portion 502 with a length of a diagonal 506 extending between opposing corners 507, 508 of the rectangular shape of the aperture defining portion 502. Conversely, the second insert 510 may have a rectangular aperture defining portion 507 with a length of a diagonal that is different than the length of the diagonal 506 of the first insert 500.

Figure 9:
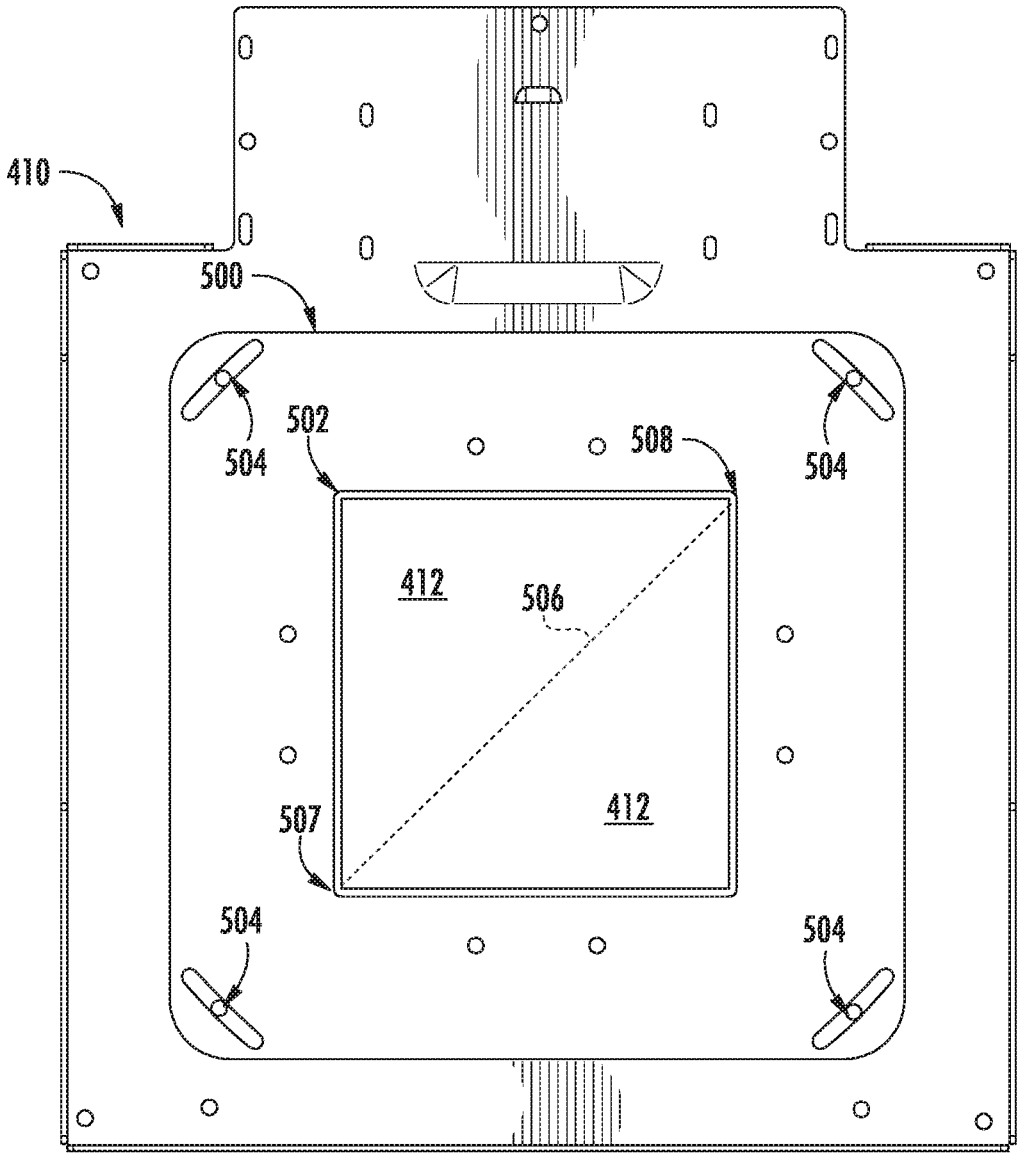
FIG. 9 provides a top view of a selected insert supported by a frame according to example embodiments of the present disclosure.
Figure 10:
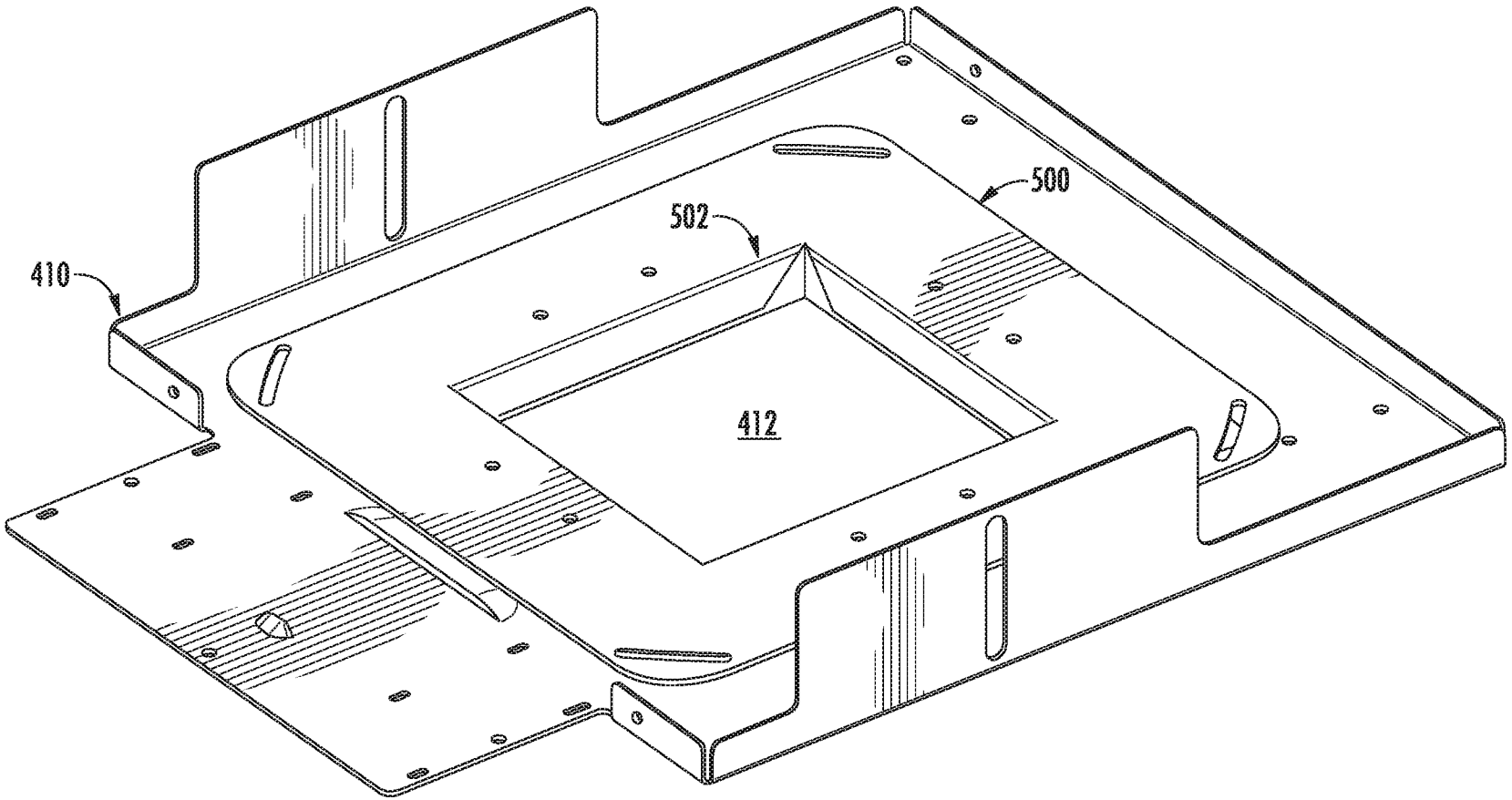
FIG. 10 provides a perspective view of a selected insert supported by a frame according to example embodiments of the present disclosure.

Referring now to FIGS. 9 and 10, the first insert 500 can be selected from the plurality of inserts 505 and can be positioned on the frame 410. More specifically, the first insert 500 can be positioned on the frame 410 such that each of a plurality of mounting holes 504 defined by the first insert 500 are aligned with a corresponding mounting hole 430 (FIGS. 5 and 6) defined by the frame 410. In this manner, the first insert 500 can be secured to the frame 410 via a fastener (not shown) extending through one of the mounting holes 504 defined by the first insert 500 and the corresponding mounting hole 430 defined by the frame 410. It should be appreciated, however, that the first insert 500 can be coupled to the frame 410 using any suitable method.

When the first insert 500 is secured to the frame 410, the aperture defining portion 502 of the first insert 500 extends through the opening 412 defined by the frame 410. It should be understood that a length of a diagonal 506 extending between opposing corners 507, 508 of the rectangular shape of the aperture defining portion 502 of the first insert 500 can be less than a length of the diagonal 422 extending between opposing corners 424, 426 of the rectangular shape of the opening 412 defined by the frame 410. In this manner, the rectangular shape of the opening 412 defined by the frame 410 can accommodate the rectangular shape of the aperture defining portion 502 of the first insert 500.

In alternative implementations, the second insert 510 can be selected from the plurality of inserts 505 instead of the first insert 500. In such implementations, the second insert 510 can be secured to the frame 410 in much the same manner as discussed above with reference to the first insert 500. Furthermore, when the second insert 510 is secured to the frame 410, it should be understood that the aperture defining portion 512 of the second insert 510 can extend through the opening 412 defined by the frame 410. It should also be understood that a diameter of the annular shape defined by the aperture defining portion 512 of the second insert 510 can be less than the diameter 428 of the annular shape of the opening 412 defined by the frame 410. In this manner, the annular shape of the opening 412 defined by the frame 410 can accommodate the annular shape of the aperture defining portion 512 of the second insert 510. Accordingly, the opening 412 of the frame 410 is configured to receive a plurality of inserts 505, where each of the plurality of inserts 505 includes an aperture defining portion 507 with a different shape or size.

Figure 11:
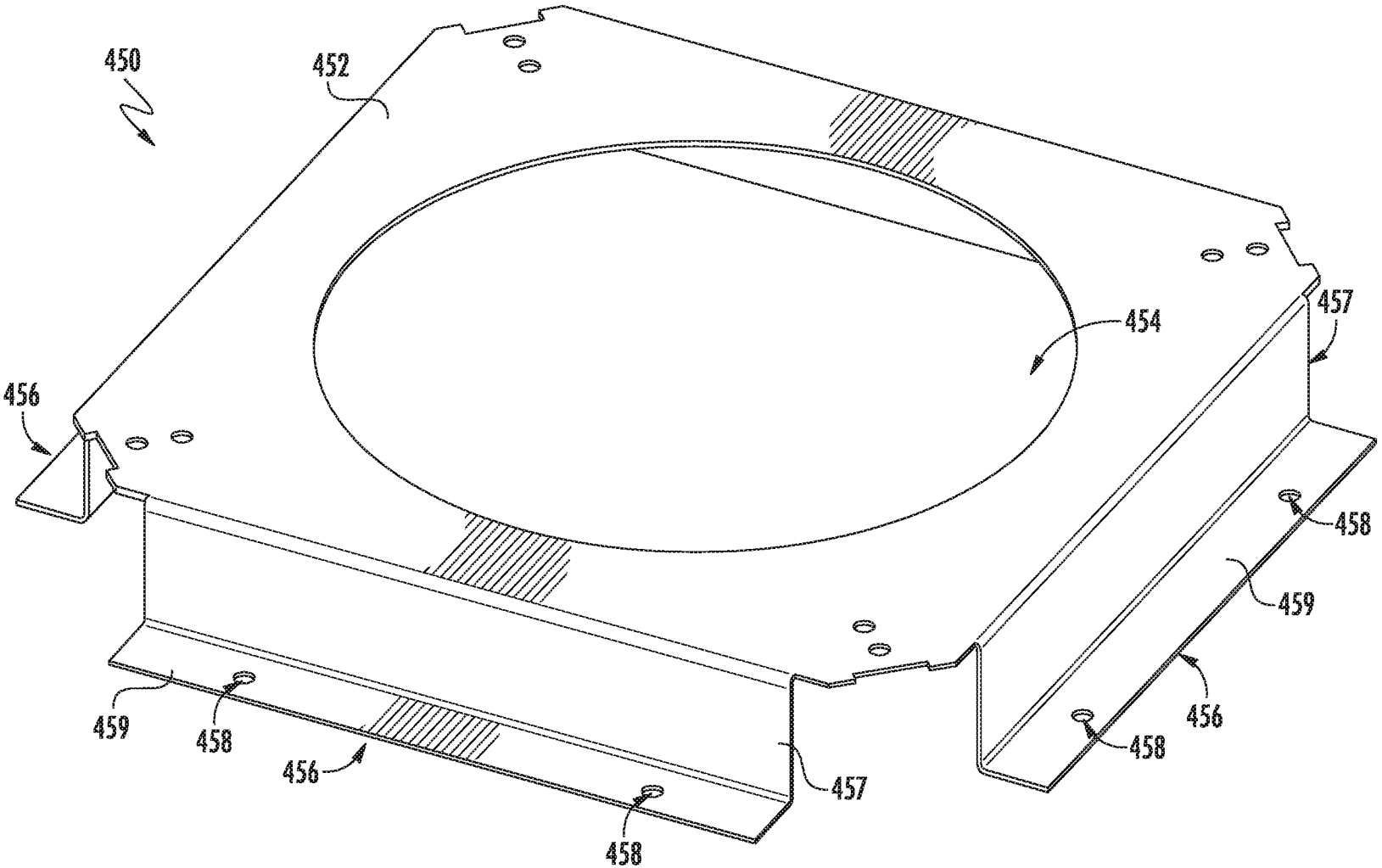
FIG. 11 provides a perspective view of a platform of a frame system according to example embodiments of the present disclosure.
Figure 12:
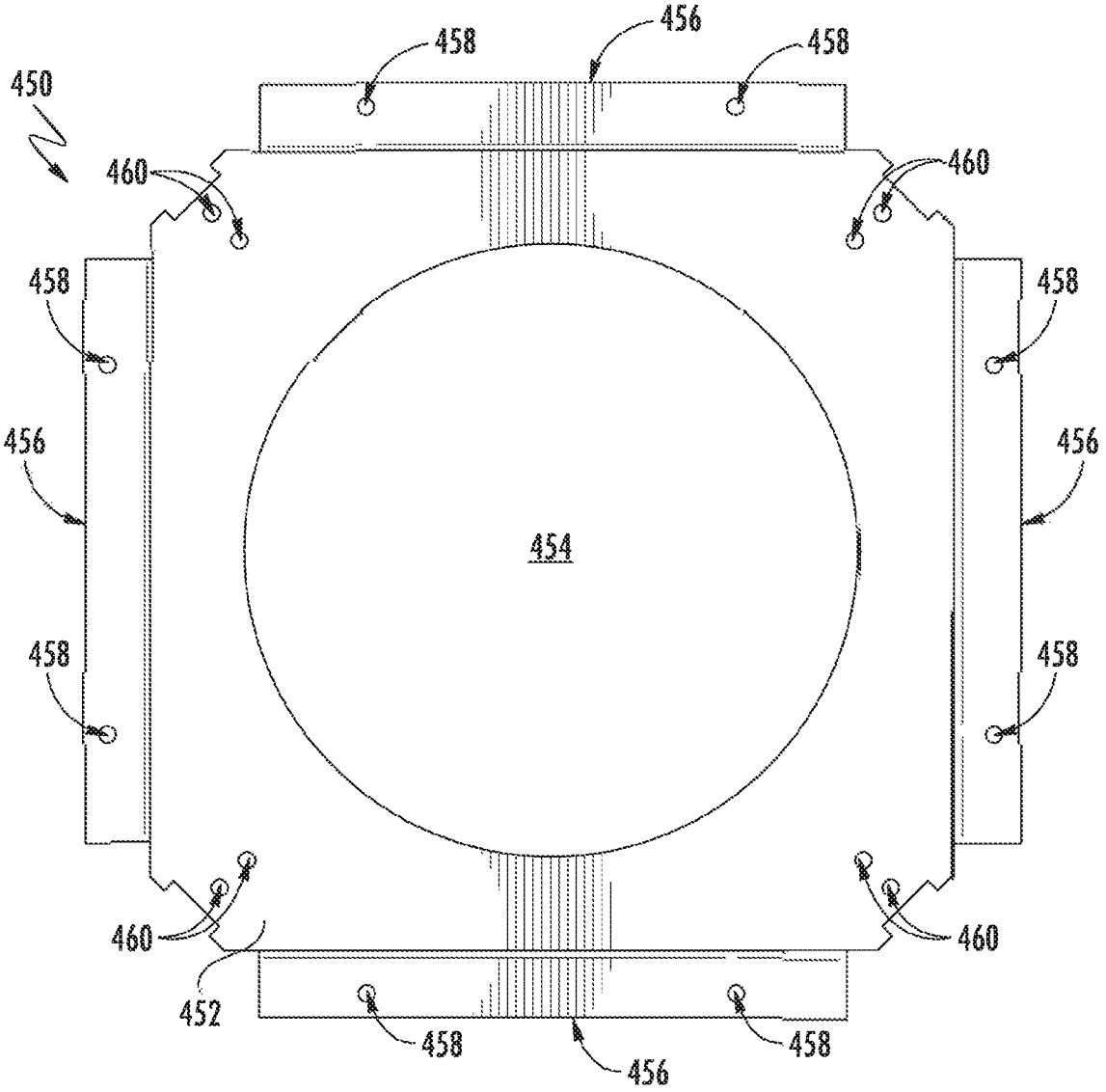
FIG. 12 provides top view of the platform of FIG. 11 according to example embodiments of the present disclosure.

Referring now to FIGS. 11 and 12, a platform 450 of the frame system 400 (FIG. 4) is provided according to example embodiments of the present disclosure 450. As shown, the platform 450 can include a body 452 defining an opening 454. Furthermore, the platform 450 can include a plurality of mounting tabs 456 extending from the body 452. Each of the plurality of mounting tabs 456 can define a plurality of mounting holes 458. In some implementation, each of the plurality of mounting tabs 456 can include a vertical member 457 and a horizontal member 459. The vertical member 457 can extend from the body 452 along the vertical direction V associated with the lighting fixture system 200 (FIG. 2). The horizontal member 459 can extend from the vertical member 457 along a plane that is substantially orthogonal to the vertical direction V associated with the lighting fixture system 200. Furthermore, the plurality of mounting holes 458 can be defined by the horizontal member 459 of each of the plurality of mounting tabs 456. In this manner, the opening 454 defined by the body 452 can be spaced apart from the plurality of mounting holes 458 along the vertical direction V associated with the lighting fixture system 200 (FIG. 2).

Figure 13:
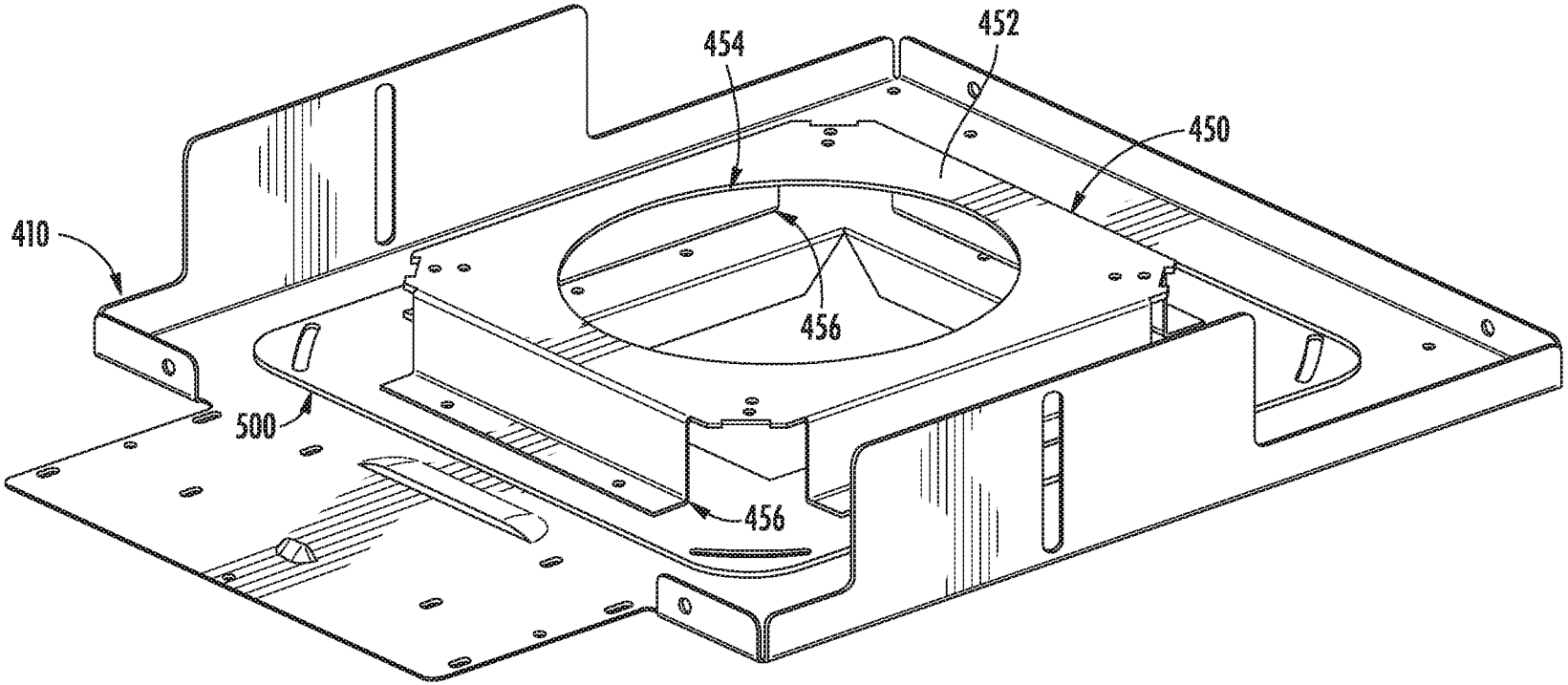
FIG. 13 provides a perspective view of a platform positioned on a selected insert supported on a frame according to example embodiments of the present disclosure.
Figure 14:
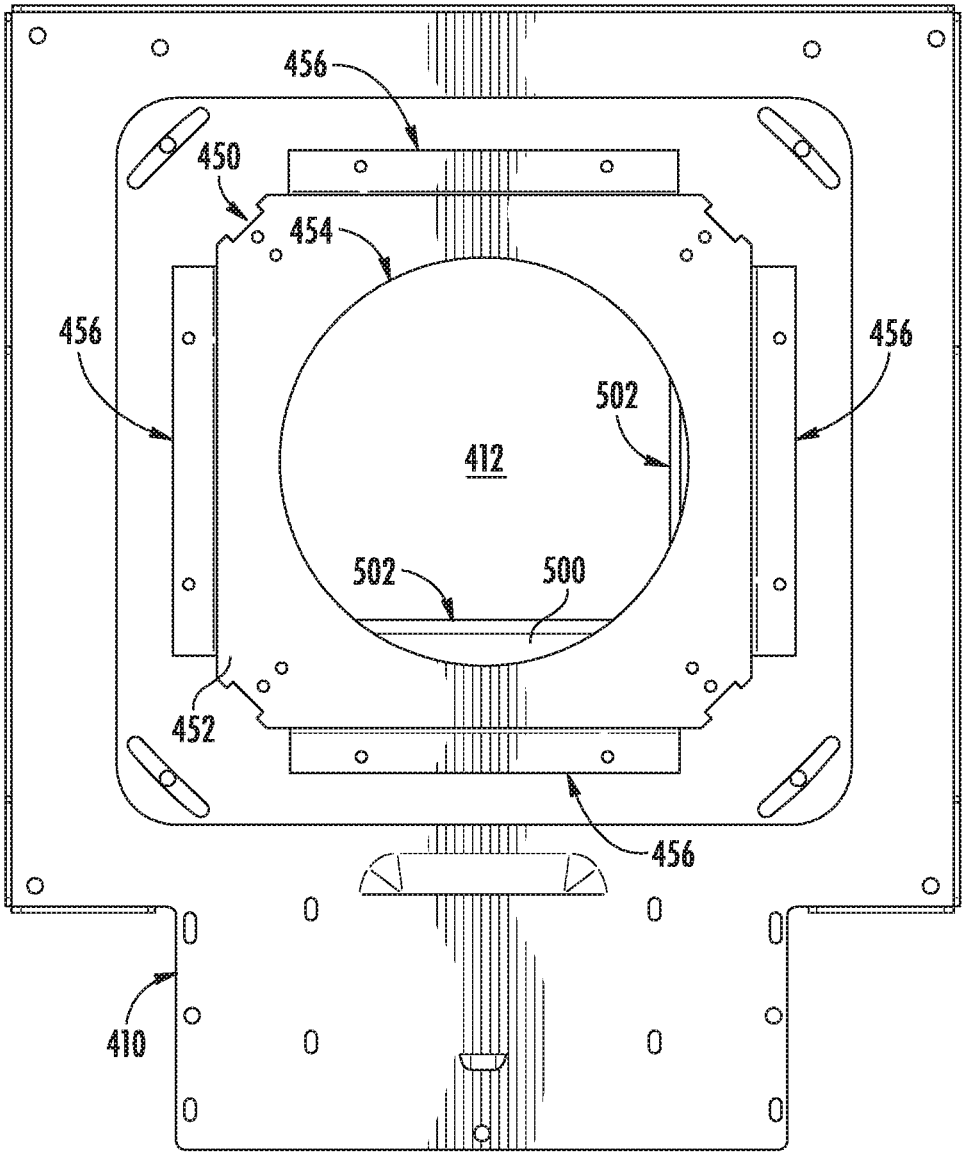
FIG. 14 provides a top view of a platform positioned on a selected insert supported on a frame according to example embodiments of the present disclosure.

Referring now to FIGS. 13 and 14, the platform 450 can be secured to the selected insert of the plurality of inserts 505 associated with the lighting fixture 300 (FIG. 3). For instance, the platform 450 can be positioned on the first insert 500 such that the plurality of mounting holes 458 defined by a corresponding mounting tab 456 of the platform 450 are aligned with a corresponding mounting hole (not shown) defined by the first insert 500. In this manner, the platform 450 can be secured to the first insert 500 via a fastener (not shown) extending through one of the mounting holes 458 defined by the corresponding mounting tab 456 of the platform 450 and the corresponding mounting hole (not shown) defined by the first insert 500. It should be appreciated, however, that the platform 450 can be coupled to the selected insert (e.g., first insert 500) using any suitable method.

In some implementation, the platform 450 can be secured to the first insert 500 such that the opening 454 defined by the body 452 of the platform 450 is aligned with the opening 412 defined by the frame 410 along the vertical direction V associated with the lighting fixture system 200 (FIG. 2). In this manner, the opening 412 defined by the frame 410 can, as shown in FIG. 14, be visible through the opening 454 defined by the body 452 of the platform 450. As will be discussed below in more detail, the lighting fixture 300 (FIG. 3) can be secured to the platform 450 according to example embodiments of the present disclosure.

Figure 15:
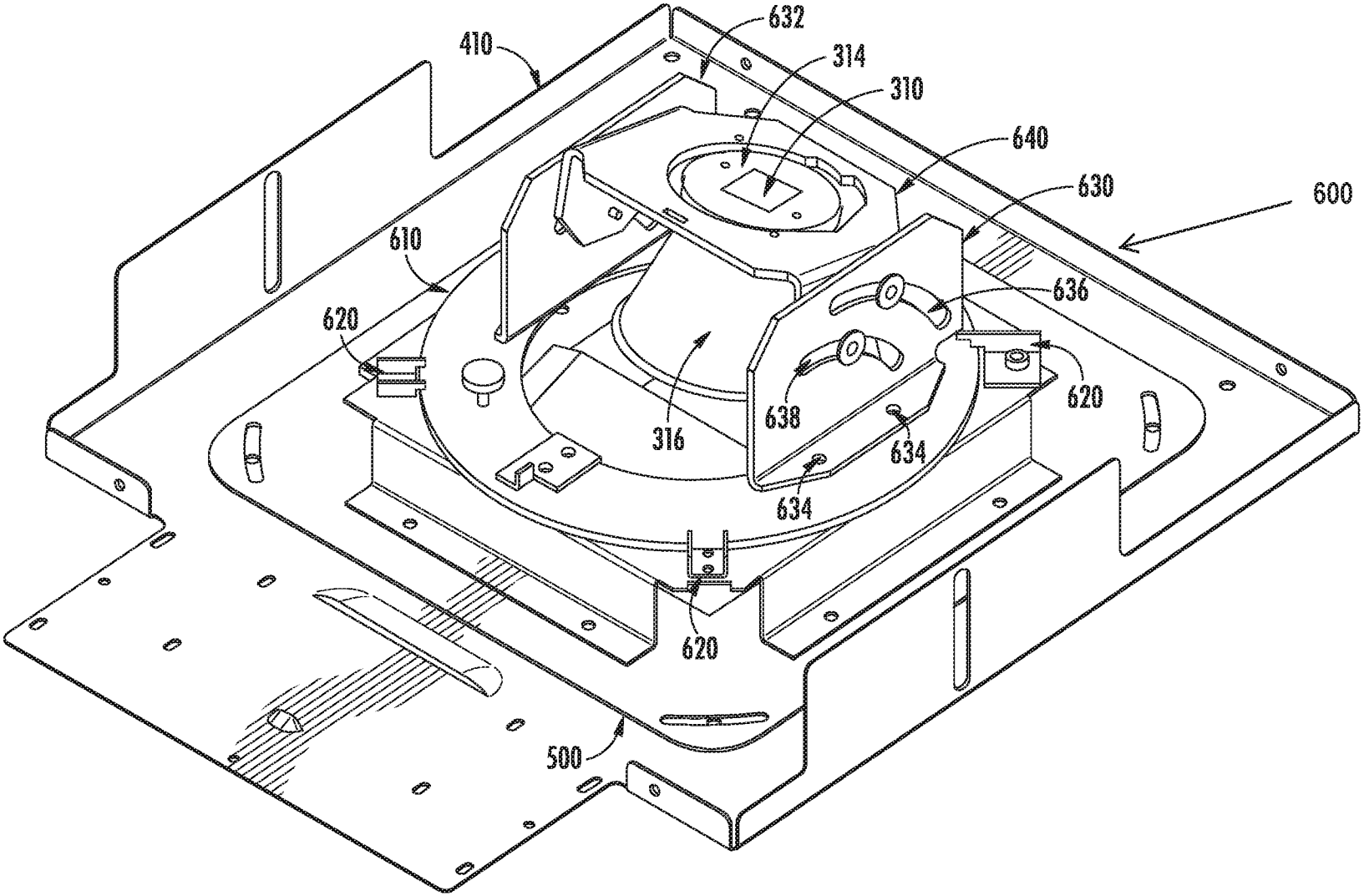
FIG. 15 provides a perspective view of a lighting fixture secured to a platform positioned on a selected insert according to example embodiments of the present disclosure FIG. 16 provides a bottom view of a lighting fixture secured to a platform positioned on a selected insert according to example embodiments of the present disclosure.
Figure 16:
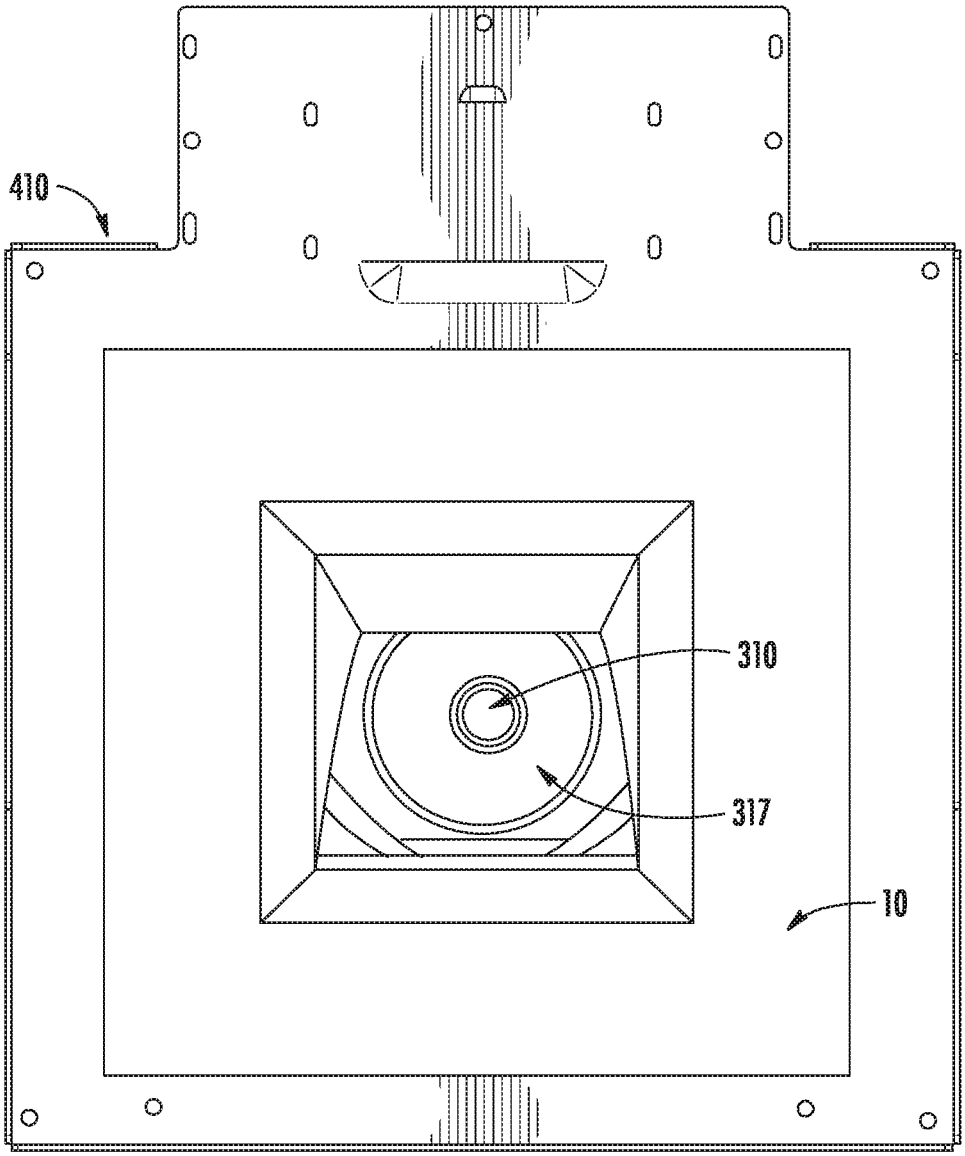

Referring now to FIGS. 15 and 16, the lighting fixture 300 (FIG. 3) of the lighting fixture system 200 (FIG. 2) can be secured (e.g., coupled) to the platform 450 via a mounting assembly 600. As shown, the mounting assembly 600 can include a base 610 positioned on the body 452 of the platform 450. Additionally, the mounting assembly 600 can include a plurality of brackets 620. As shown, the plurality of brackets 620 can each be positioned on the body 452 of the platform 450. More specifically, each of the plurality of brackets 620 can be positioned on the body 452 such that one or more mounting holes (not shown) defined by a corresponding bracket 620 is aligned with a corresponding mounting hole 460 (FIG. 12) defined by the body 452 of the platform 450. In this manner, the plurality of brackets 620 can be secured to the body 452 of the platform via a fastener (not shown) extending through the mounting hole defined by one of the brackets 620 and a corresponding mounting hole 460 defined by the body 452 of the platform 450.

Furthermore, when the brackets 620 are secured to the body 452 of the platform 450, at least a portion of each of the plurality of brackets 620 can be positioned over the base 610 along the vertical direction V. In this manner, the base 610 can be retained against the platform 450. Alternatively and/or additionally, in some implementations, the base 610 can define one or more mounting holes (not shown) and can be secured to the body 452 of the platform 450 via a fastener extending through the mounting hole define by the base 610 and a corresponding mounting hole (not shown) defined by the body 452 of the platform 450.

In some implementations, the mounting assembly 600 can include a first side bracket 630 and a second side bracket 632. As shown, the first side bracket 630 and the second side bracket 632 can each define a plurality of mounting holes 634. The first side bracket 630 can be positioned on the base 610 such that each of the plurality of mounting holes 634 defined by the first side bracket 630 is aligned with a corresponding mounting hole (not shown) defined by the base 610. In this manner, the first side bracket 630 can be secured to the base 610 via a fastener (not shown) extending through one of the mounting holes 634 defined by the first side bracket 630 and a corresponding mounting hole (not shown) defined by the base 610. It should be understood that the second mounting bracket 632 can be secured to the base 610 in the same manner.

In some implementations, the mounting assembly 600 can include a top bracket 640 coupleable to the lighting fixture 300. More specifically, the top bracket 640 can be coupleable to the support 312 of the lighting fixture 300. Furthermore, as will be discussed below in more detail, the top bracket 640 can be coupled to each of the first side bracket 630 and the second side bracket 632.

As shown in FIG. 15, the top bracket 640 can also be coupled to the first side bracket 630 and the second side bracket 632 via fasteners 650. In some implementations, each of the fasteners 650 can be positioned with a corresponding channel (e.g., first channel 636, second channel 638) defined by each of the first side bracket 630 and the second side bracket 632. In this manner, the top bracket 640 can move (e.g., slide) relative to the first side bracket 630 and the second side bracket 632 via movement of the fasteners 650 within the first channel 636 and the second channel 638, respectively. Furthermore, since the lighting fixture 300 is coupled to the top bracket 640, the lighting fixture 300 can move relative to the first side bracket 630 and the second side bracket 632 via movement of the fasteners 650 within the first channel 636 and the second channel 638, respectively.

As shown in FIG. 16, the lighting fixture 300 can be positioned via movement of the top bracket 640 relative to the first side bracket 630 and the second side bracket 632 such that light emitted from the solid-state light source 310 is emitted through the opening 454 (FIG. 12) defined by the body 452 of the platform 450 and the opening 412 defined by the frame 410. In this manner, the light can illuminate the first space 12 (FIG. 1) positioned below the ceiling 10.

Figure 17:
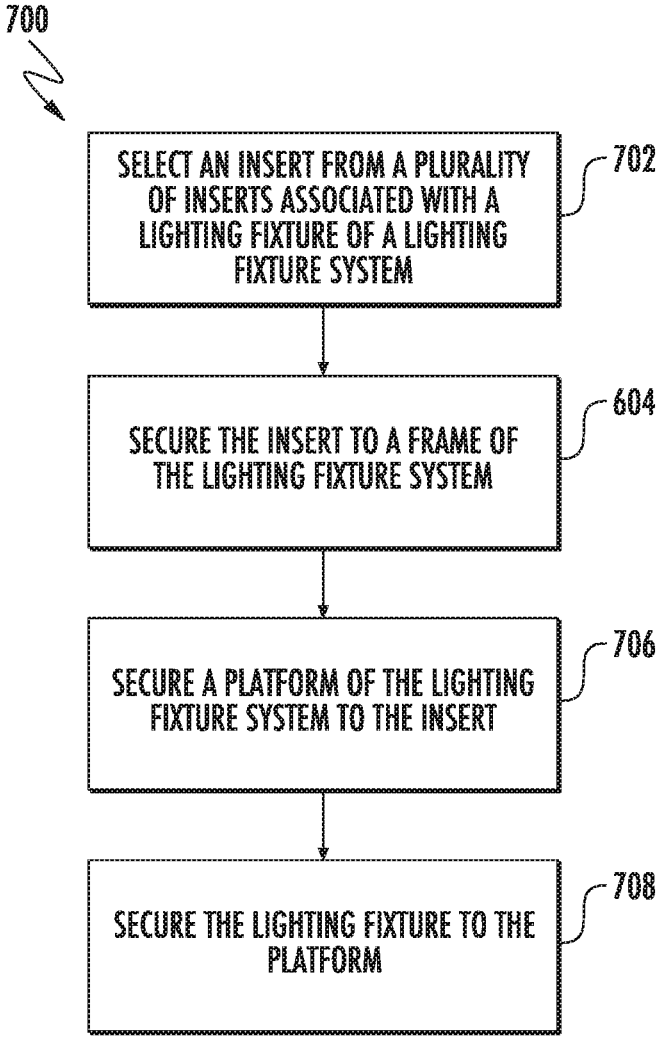
FIG. 17 provides a flow diagram of a method for assembling a lighting fixture system according to example embodiments of the present disclosure.

Referring now to FIG. 17, a flow diagram of a method 700 for assembling a lighting fixture system 200 is provided according to example embodiments of the present disclosure. It should be appreciated that the method 700 can be implemented using the lighting fixture system 200 discussed above with reference to FIG. 2. FIG. 17 depicts steps performed in a particular order for purposes of illustration and discussion. Those of ordinary skill in the art, using the disclosures provided herein, will understand that various steps of the method 600 may be adapted, modified, rearranged, performed simultaneously or modified in various ways without deviating from the scope of the present disclosure.

At (702), the method 700 can include selecting an insert from a plurality of inserts 505 of the lighting fixture system 200. In some implementations, each of the plurality of inserts 505 can be associated with a lighting fixture 300 of the lighting fixture system 200. Furthermore, each of the plurality of inserts 505 can include an aperture defining portion 507 of a different size or shape.

At (704), the method 700 can include securing the insert 505 selected at (702) to a frame 410 of the lighting fixture system 200. More specifically, the insert 505 selected at (702) can be secured to the frame 410 such that the aperture defining portion 507 of the insert 505 extends through an opening 412 defined by the frame 410.

At (706), the method 700 can include securing a platform 450 of the lighting fixture system 200 to the insert 505 subsequent to securing the insert 505 to the frame 410. More specifically, the platform 450 can be positioned on the insert 505 such that a plurality of mounting holes 634 defined by a corresponding mounting tab 456 of the platform 450 are aligned with a corresponding mounting hole 504 defined by the insert 505. In this manner, the platform 450 can be secured to the first insert 505 via a fastener extending through one of the mounting holes 634 defined by corresponding mounting tab 456 of the platform 450 and the corresponding mounting hole 504 defined by the insert 505.

At (708), the method 700 can include securing the lighting fixture 300 to the platform 450 subsequent to securing the platform 450 to the insert 505 at (706). More specifically, the lighting fixture 300 can be secured to the platform 450 such that light emitted from the solid-state light source 310 of the lighting fixture 300 is emitted through the opening 454 defined by the platform 450 and the opening 412 defined by the frame 410.

Figure 18:
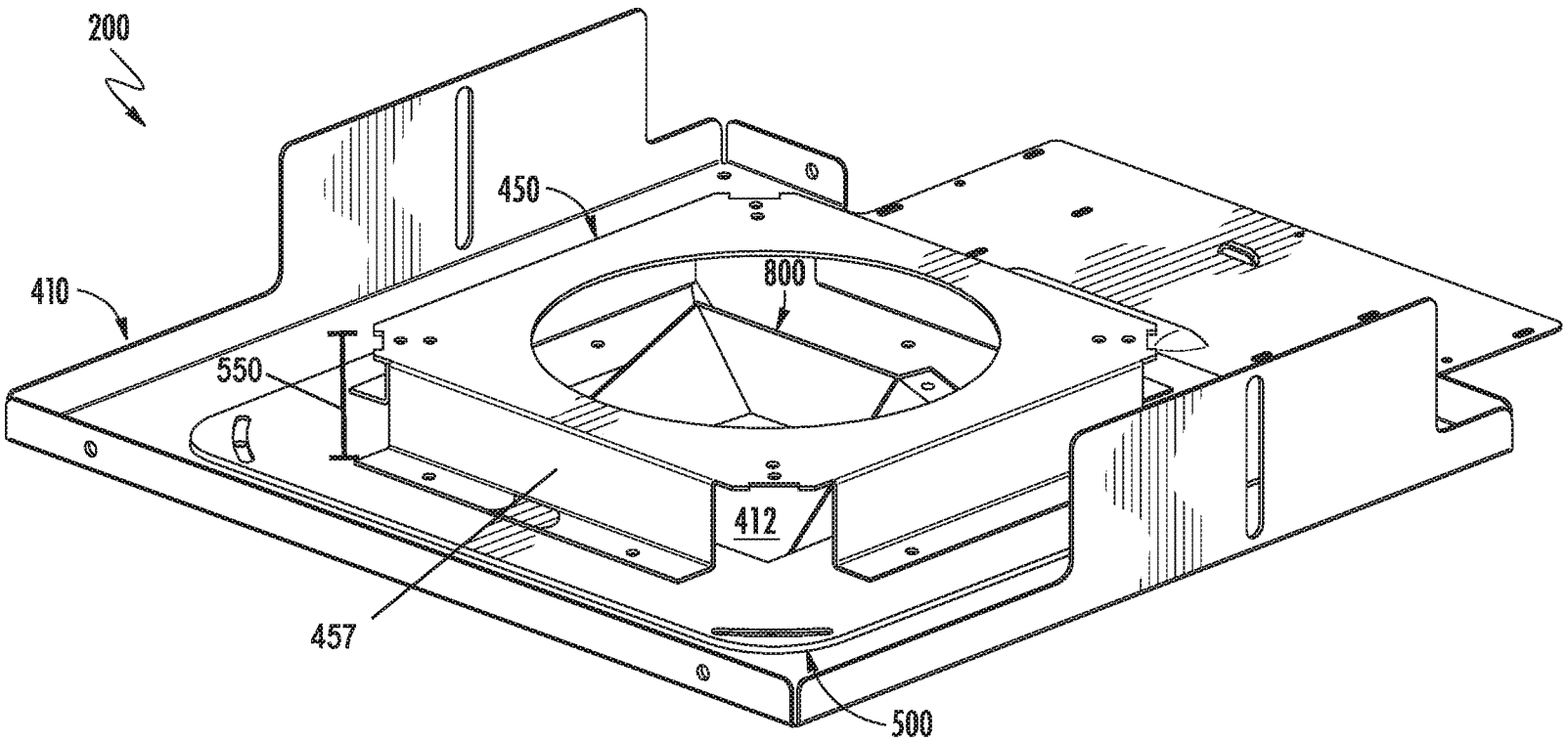
FIG. 18 provides a perspective view of a reflector of a lighting fixture assembly positioned within an opening defined by a frame of the lighting fixture system according to example embodiments of the present disclosure.
Figure 19:
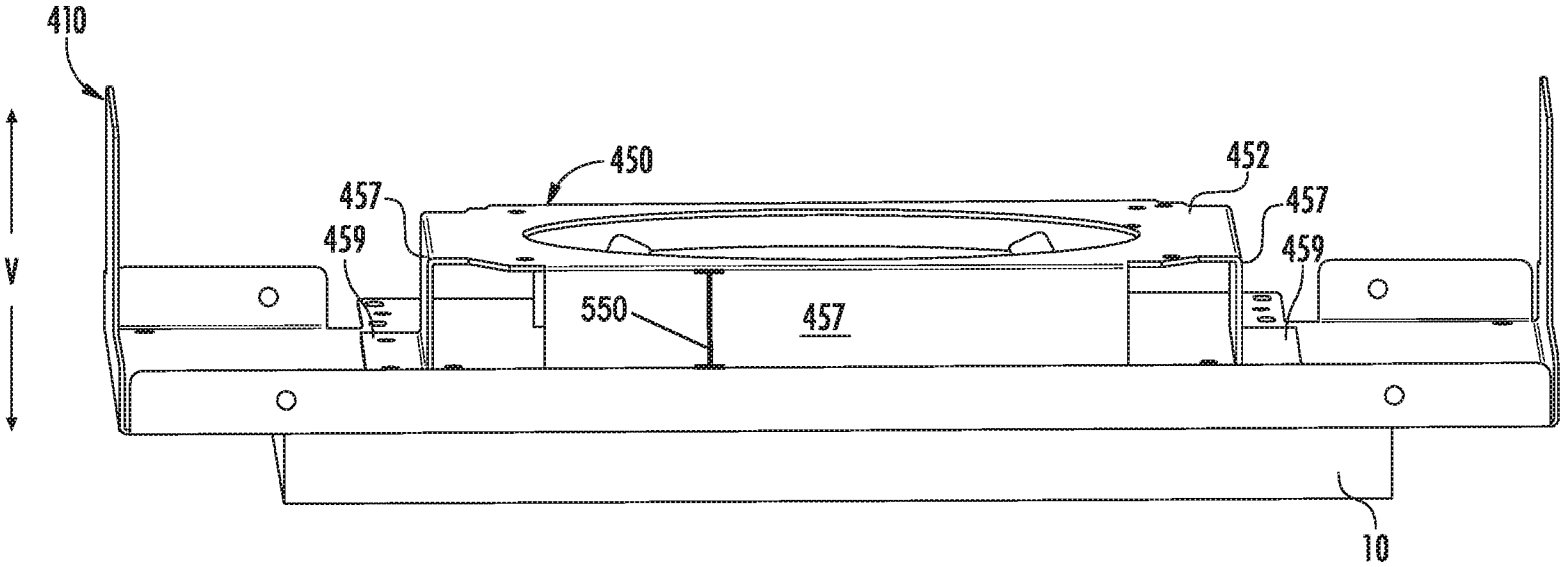

Referring now to FIGS. 18 and 19, the lighting fixture system 200 can, in some implementations, include a reflector 800 that is separate from the reflector 316 (FIG. 3) of the lighting fixture 300. The reflector 800 can be positioned within the opening 412 defined by the frame 410 of the lighting fixture system 200. In this manner, one or more rays of light emitted from the solid-state light source 310 (FIG. 3) of the lighting fixture 300 (FIG. 3) can reflect off of one or more interior surfaces of the reflector 800 positioned within the opening 412 prior to entering the room or area illuminated by the lighting fixture 300. Although the reflector 800 is depicted as having a rectangular shape, it should be appreciated that the reflector 800 can be configured to have any suitable shape.

Furthermore, as shown, a height 550 of the platform 450 can be sufficient such that the reflector 800 does not interfere (e.g., contact) with the mounting assembly 600 (FIG. 15) used to secure the lighting fixture 300 (FIG. 3) to the body 452 of the platform 450. More specifically, the height 550 of the vertical member 457 of each of the plurality of mounting tab 456 can be sufficient such that the body 452 of the platform 450 is spaced apart from the reflector 800 along the vertical direction V associated with the lighting fixture system 200. In this manner, a position of the lighting fixture 300 can be adjusted via the mounting assembly 600 without interfering with the reflector 800 positioned within the opening 412 defined by the frame 410.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A frame system for securing a lighting fixture to a surface, the frame system comprising:

a plurality of inserts associated with the lighting fixture, each of the plurality of inserts having an aperture defining portion, wherein the aperture defining portion of a first insert of the plurality of inserts defines an annular shape and the aperture defining portion of a second insert of the plurality of inserts defines a rectangular shape;

a frame configured to be selectively couplable to the plurality of inserts, the frame defining an opening for receiving the selected insert of the plurality of inserts, wherein the opening is sized and shaped to receive the aperture defining portion of each of the plurality of inserts, shape, and wherein, when the selected insert is coupled to the frame, the aperture defining portion of the selected insert extends through the opening defined by the frame, wherein the opening is defined by a plurality of arc shaped edges of the frame and a plurality of linear edges of the frame, the plurality of arc shaped edges collectively defining an annular shape and the plurality of linear edges collectively defining a rectangular shape, wherein the annular shape of the opening is configured to accommodate the annular shape of the aperture defining portion of the first insert, and wherein the rectangular shape is configured to accommodate the rectangular shape of the aperture defining portion of the second insert.

2. The frame system of claim 1, wherein a diameter of the circular shape of the opening is smaller than a length of a diagonal extending between two opposing corners of the rectangular shape of the opening.

3. The frame system of claim 1, wherein the the annular shape of the first insert has a first diameter and, wherein further, the aperture defining portion of a third insert of the plurality of inserts defines an annular shape of a second diameter that is different than the first diameter.

4. The frame system of claim 1, wherein the selected insert is the second insert of the plurality of inserts, and wherein the rectangular shape is a square shape.

5. The frame system of claim 4, wherein a long dimension of the opening defined by the frame is greater than the length of the diagonal of the square shape of the aperture defining portion of the selected insert.

6. The frame system of claim 1, further comprising a platform coupleable to the frame and the lighting fixture, the platform including a body defining an opening and a plurality of mounting tabs extending from the body, each of the plurality of mounting tabs defining one or more mounting holes.

7. The frame system of claim 6, wherein the one or more mounting holes defined by the plurality of mounting tabs are spaced apart from the opening defined by the body.

8. The frame system of claim 6, wherein when the platform is coupled to the frame and the lighting fixture, and wherein the opening defined by the body of the platform is aligned with the opening defined by the frame such that light from one or more light sources of the lighting fixture is emitted through the opening defined by the frame and the opening defined by the body of the platform.

9. A lighting fixture system comprising:

a lighting fixture;

a plurality of inserts associated with the lighting fixture, each of the plurality of inserts having an aperture defining portion, wherein the aperture defining portion of a first insert of the plurality of inserts defines an annular shape and the aperture defining portion of a second insert of the plurality of inserts defines a rectangular shape; and a frame system for securing the lighting fixture to a surface, the frame system including a frame coupleable to a selected insert of the plurality of inserts; and a platform coupleable to the frame via the selected insert, the platform further coupleable to the lighting fixture, wherein when the frame is coupled to the selected insert, the aperture defining portion of the selected insert extends through an opening defined by the frame, wherein a first of the plurality of inserts includes an aperture defining portion of a first size and shape and a second of the plurality of inserts includes an aperture defining portion of a second size or shape which is different from the first of the plurality of inserts, wherein the opening is defined by a plurality of arc shaped edges of the frame and a plurality of linear edges of the frame, the plurality of arc shaped edges collectively defining an annular shape and the plurality of linear edges collectively defining a rectangular shape, wherein the annular shape of the opening is configured to accommodate the annular shape of the aperture defining portion of the first insert, and wherein the rectangular shape is configured to accommodate the rectangular shape of the aperture defining portion of the second insert.

10. The system of claim 9, wherein the lighting fixture defines an annular shape and the aperture defining portion of the selected insert defines a square shape.

11. The system of claim 10, wherein a long dimension of the opening defined by the frame is greater than a length of a diagonal extending between two opposing corners of the square shape.

12. The frame system of claim 9, wherein the platform includes a body defining an opening and a plurality of mounting tabs extending from the body, each of the plurality of mounting tabs defining one or more mounting holes.

13. The frame system of claim 12, wherein the one or more mounting holes defined by the plurality of mounting tabs are spaced apart from the opening defined by the body along a vertical direction.

14. The frame system of claim 9, wherein when the platform is coupled to the frame and the lighting fixture, and wherein the opening defined by the body of the platform is aligned with the opening defined by the frame such that light from one or more light sources of the lighting fixture is emitted through the opening defined by the frame and the opening defined by the body of the platform.

15. A method for assembling a lighting fixture system, the method comprising:

selecting a first insert from a plurality of inserts of the lighting fixture system, each of the plurality of inserts including an aperture defining portion, wherein the aperture defining portion of the first insert of the plurality of inserts defines an annular shape and the aperture defining portion of a second insert of the plurality of inserts defines a rectangular shape;

securing the first insert to a frame of lighting fixture system such that the aperture defining portion of the insert extends through an opening defined by the frame, wherein the opening is defined by a plurality of arc shaped edges of the frame and a plurality of linear edges of the frame, the plurality of arc shaped edges collectively defining an annular shape and the plurality of linear edges collectively defining a rectangular shape, wherein the annular shape of the opening is configured to accommodate the annular shape of the aperture defining portion of the first insert, and wherein the rectangular shape is configured to accommodate the rectangular shape of the aperture defining portion of the second insert, and subsequent to securing the first insert to the frame, securing a platform of the lighting fixture system to the frame such that an opening defined by the platform is aligned with the opening defined by the frame, the platform having a body defining the opening and a plurality of mounting tabs extending from the body toward the frame, each of the plurality of mounting tabs defining one or more mounting holes.

16. The method of claim 15, further comprising:

securing the lighting fixture to the platform such that light emitted from one or more light sources of the lighting fixture is emitted through the opening defined by the platform and the opening defined by the frame.

17. The method of claim 15, wherein the lighting fixture has an annular shape.

18. The method of claim 15, wherein the shape of the lighting fixture is square.

* * * * *